United States Patent [19]

McCreary

[11] 4,089,180

[45] May 16, 1978

[54] LONG-LIFE FLOODGATE

[76] Inventor: Norman B. McCreary, 45 Lakeshore Dr., Little Rock, Ark. 72204

[21] Appl. No.: 815,001

[22] Filed: Jul. 12, 1977

[51] Int. Cl.[2] ..... E02B 7/20

[52] U.S. Cl. ..... 61/29

[58] Field of Search ..... 61/29, 22, 27, 30

[56] References Cited

U.S. PATENT DOCUMENTS

| | | | |
|---|---|---|---|
| 2,674,855 | 4/1954 | Taylor | 61/29 |
| 2,729,944 | 1/1956 | Bentrup | 61/29 |
| 3,518,833 | 7/1970 | Bogart | 61/29 |

*Primary Examiner*—Paul R. Gilliam
*Assistant Examiner*—David H. Corbin
*Attorney, Agent, or Firm*—Cushman, Darby & Cushman

[57] ABSTRACT

The invention relates to a floodgate for use with an earthen levee having a cut therein. The floodgate includes a generally rectangular piece of sheet material having sufficient dimensions to cover the area of the levee defining the cut when the floodgate is in its water-passing position. The floodgate further includes an elongated relatively rigid pole having a length greater than the width of the cut in the levee. A loop is formed in the piece of sheet material along one end thereof, generally across the width thereof, and having a void area encompassed thereby at least as great as the cross-sectional area of the pole so that the pole may be received by the loop, and so that the pole may be rotated to wrap the sheet material around the pole while the pole is received by the loop. Preferably, the sheet is polyethylene having ultra-violet inhibitor, about 14 to 16 mils thick, and about 9 feet by 4 or more feet.

9 Claims, 6 Drawing Figures

LONG-LIFE FLOODGATE

BACKGROUND AND SUMMARY OF THE INVENTION

In many areas of the country where irrigation is practiced, earthen levees are provided, which have a high water side and a low water side. By placing a floodgate in an earthen levee, which has a cut therein, in a flow-passing position, water is allowed to flow from the high water side of the levee to the low water side thereof.

Conventional floodgates on the market include steel and fiberglass floodgates which are placed in the cuts in the levee. Steel floodgates, while effective, are very expensive (about $30.00 to $40.00), a lift is needed to install them, they must be repainted yearly to have any significant life, and they rarely last more than 3 to 5 years even if painted. Fiberglass floodgates are susceptible to destruction by animals such as muskrats, and therefore often are not even operative for a full season. It has also been known in the past for individuals to purchase sheets of fabric and nail cypress logs to one end thereof, and use the fabric as a floodgate, however such floodgates rarely last for more than a year due to the deleterious effects of the environment on the fabric.

According to the present invenion, a floodgate is provided that is much less expensive than the steel floodgates — perhpas being about $4.00 to $5.00 in cost — yet will last for three to five seasons before it must be replaced. The floodgate according to the present invention comprises a generally rectangular piece of sheet material having a sufficient length to pass from the bottom of one side of the levee, over the crown of the levee, to the bottom of the other side of the levee, and having sufficient width to extend completely across the width of the cut in the levee and a substantial distance on either side of the cut in the levee. In the flow-passing position of the floodgate, the sheet material completely lines the cut in the levee. The floodgate also includes an elongated relatively rigid pole having a length greater than the width of the cut in the levee, and having a cross-sectional area, and a loop formed in the piece of sheet material along one end thereof, generally across the width thereof, the loop having a void area encompassed thereby at least as great as the cross-sectional area of the pole so that the pole may be received by the loop, and so that the pole may be rotated to wrap the sheet material around the pole while the pole is received by the loop. For long life, the sheet material may be nylon coated with plastic (with ultraviolet inhibitor), or polypropylene or polyethylene having ulatraviolet inhibitor incorporated therein. Preferably, about 10% conventional ultraviolet inhibitor is incorporated therein, and the plastic sheet is about 14 to 16 mils thick. In normal usage, the polyethylene sheet will be about 9 feet wide and about 4 or more feet long, not including the loop, and the void area defined by the loop will be about 5.5 square inches, and can accomodate poles of varying cross-sectional shape.

In combination with an earthen levee having a cut therein, the edge of the sheet opposite the loop is buried underground on the high water side of the levee, and the edges of the sheet adjacent the edge opposite the edge of the sheet having the loop are buried along the length thereof up to approximately the crown of the levee, and are free from the crown of the levee toward the low water side of the levee. The levee may have a depression formed in the crown thereof for receipt of the pole with part of the plastic sheet wrapped therearound.

In using the floodgate, when the floodgate is to act to prevent flow of water from the high water side to the low water side, the pole is used to wrap up about half of the length of the sheet, and the pole width sheet wrapped therearound is placed on the crown of the levee. When it is then desired to allow flow through the cut in the levee, the sheet material around the pole is unwrapped, and the pole is placed at the bottom of the low water side of the levee, whereby the sheet deforms to lie in the cut in the levee but allows flow of water from the high water side to the low water side.

It is a primary object of the present invention to provide a long life, simple, inexpensive floodgate for use with earthen levees. This and other objects of the invention will become clear from an inspection of the detailed description of the invention and from the appended claims.

DETAILED DESCRIPTION OF THE INVENTION

Figure 1:
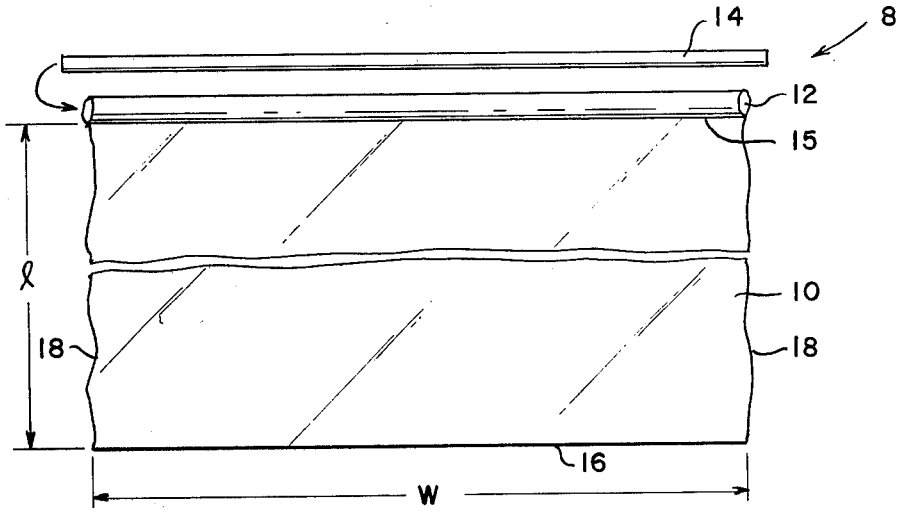
FIG. 1 is an exploded, perspective view of the component parts of a floodgate according to the invention.
Figure 2:
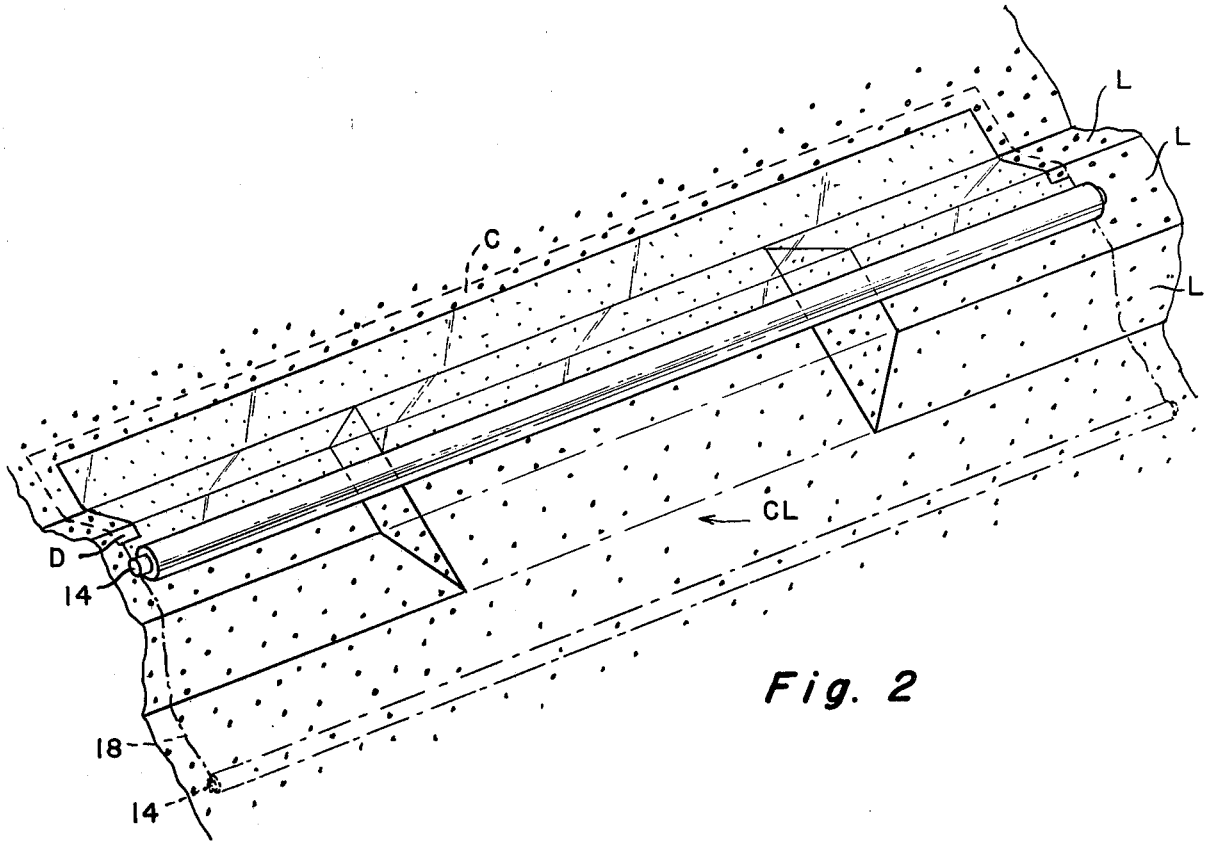
FIG. 2 is a perspective view of a floodgate according to the invention in use with an earthen levee, illustrating the floodgate in the flow-blocking position in solid line, and in flow-passing position in dotted line.
Figure 6:
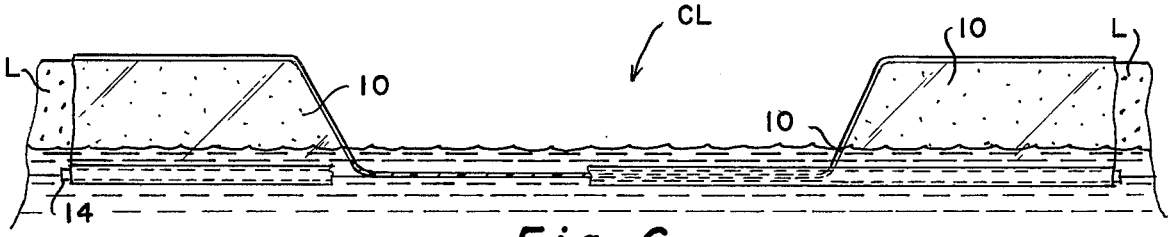
FIG. 6 is a front view of the floodgate and flow-passing position thereof viewed from the low water side of the levee.

The invention relates to a simple, inexpensive, long life floodgate 8 (see FIG. 1) for use with an earthen levee L having a cut CL therein. The floodgate 8 comprises two basic components, a generally rectangular piece of sheet material 10 having a loop 12 formed along one end thereof generally across the width thereof, and an elongated relatively rigid pole 14. The piece of sheet material 10 has a sufficient length *l* (see FIG. 1) to pass from the bottom of one side of the levee over the crown of the levee to the bottom of the other side of the levee (see FIG. 4), and has a sufficient width W (see FIG. 1) to extend completely across the width of the cut CL in the levee L and a substantial distance on either side of the cut CL (see FIG. 2), so that in a flow-passing position of the floodgate, the sheet material 10 completely lines the cut CL in the levee L (see FIG. 6). The relatively rigid pole 14 has a length greater than the width of the cut CL in the levee L and has a cross-sectional area, the cross section being of any shape. The pole may be made of wood, aluminum, or other suitable relatively rigid material, preferably one that is resistant to corrosion. The loop 12 formed in the piece of sheet material 10 along one edge 15 thereof, generally across the width W thereof, has a void area encompassed thereby at least as great as the cross-sectional area of the pole 14 so that the pole may be received by the loop 12, and so that the pole 14 may be rotated to wrap the sheet material 10 around the pole 14 while the pole is received by the loop 12.

Preferably, for long life of the floodgate 8, the sheet material 10 comprises a plastic sheet, preferably polyethylene. The polyethylene as a conventional commercially available ultraviolet inhibitor — such as Ampacet 10057 made by Ampacet Corp., Mount Vernon, N.Y. — incorporated therein during the manufacture thereof, and preferably has about 10% ultraviolet inhibitor incorporated therein so that the sheet 10 will last through three to five seasons. It is desirable that the sheet be about 14 to 16 mils thick for best service. Other suitable materials for sheet 10 are polypropylene and nylon coated with plastic or the like or otherwise that it is water impervious.

For use with most conventional levees, which are about 8 to 20 inches high and 3 to 4 feet across at the base, and have a cut formed therein that is about 4 feet wide at the base and about 4 to 6 feet wide at the top, the plastic sheet is about 9 feet wide, (W), and about 4 feet or more long (1). a normal pole 14 that would be used would have a rectangular cross-sectional area of about 2 by 1.75 inches, and the loop 12 would normally have a void area of about 5.5 square inches to accommodate such pole 14. Because the loop 12 is formed in the flexible sheet material, it can accommodate poles 14 of various cross-sectional shapes, and having a maximum cross-sectional area equal to the void area of the loop.

In use, as a floodgate, the front edge 16 of the sheet 10 is placed on the high water side of the levee L at the bottom thereof, and a certain area C of the sheet 10 adjacent the front edge 16 is covered with earth, as clearly illustrated in FIGS. 2 through 5. The width W of the sheet extends a significant distance past the cut CL in the levee L on either side thereof. The sheet 10 is then layed so that the side edges 18 thereof extend from the high water side A of the levee over the crown of the levee. The edges 18 are buried along the length 1 of the sheet on the high water side A of the levee L up to the crown, an area D (see FIG. 5) adjacent each edge 18 being buried underground. The portion of the edge 18 past the crown of the levee is free, not being buried, and the edge 15 of the sheet 10 which has loop 12 is similarly free (see FIG. 5 in particular).

Figure 3:
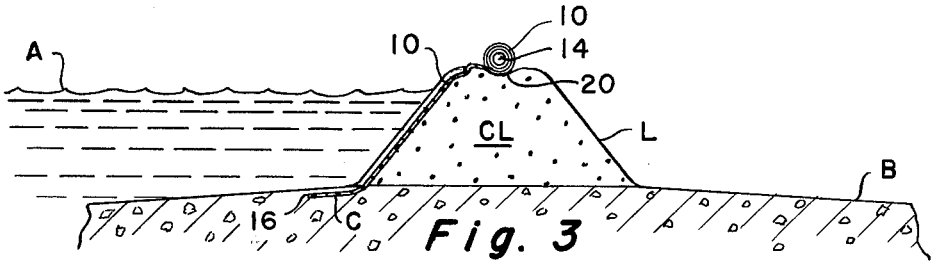
FIG. 3 is a side view, showing the floodgate in a flow-blocking positon.

In use of the floodgate according to the invention, normally the floodgate 8 will act to prevent flow of water from the high water side A of the levee L to the low water side B of the levee L, as shown in FIG. 3. To place the floodgate 8 in flow-blocking position, the pole 14, which is received by the loop 12, is grasped, and rotated to roll up the sheet material therearound, the sheet material being rolled up until substantially all of the free portions of the edges 18 of the sheet 10 are wrapped around the pole 14, but the buried portions (area D) of the edges 18 are left undisturbed. The pole 14 is then disposed on the top of the levee L — as shown in FIG. 3 — cooperating with the buried edges 16 and 18 of the sheet 10 to prevent passage of water from the high water side of the levee to the low water side. If desired, a depression 20 (see FIG. 3) may be formed in the crown of the levee L for receipt of the pole 14 with sheet material 10 wrapped therearound.

Figure 4:
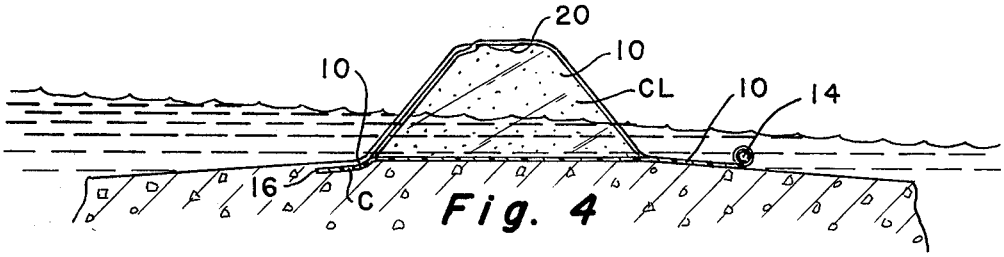
FIG. 4 is a side view like FIG. 3 only showing the floodgate in flow-passing position.
Figure 5:
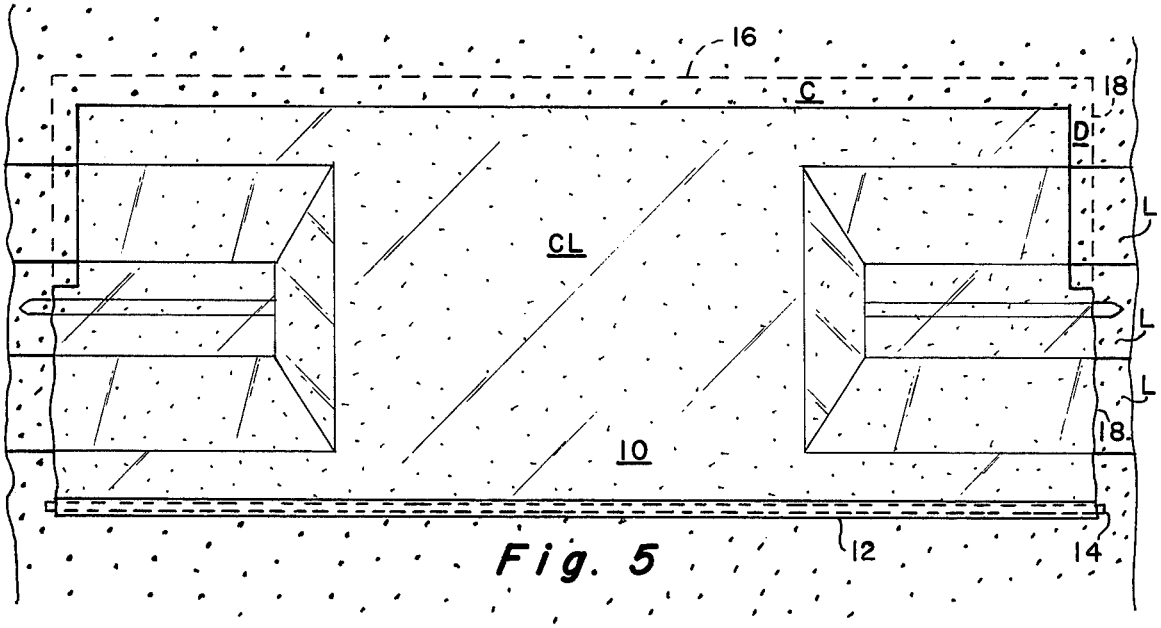
FIG. 5 is a top plan view of the floodgate as illustrated in FIG. 4.

To allow water to flow from the high water side A to the low water side B of the levee, one simply unwraps the sheet material 10 from around the pole 14, and lays the pole 14 loosely at the bottom of the levee on the down water side thereof, as shown in FIG. 4. In such a position, the flexible sheet material 10 deforms to completely line the cut CL in the levee L as shown clearly in FIGS. 4 through 6, so that water flowing through the cut CL in the levee will not erode the earthen levee L. After sufficient flow of water from the high water side to the low water side of the levee L, the pole 14 again will be grasped and the sheet material 10 rolled therearound to again effect blockage of the flow.

A floodgate as according to the present invention, and in the combination with an earthen levee as according to the present invention, is extremely simple and easly to construct and install, is relatively cheap, and has a long life. For instance, such floodgates can be sold for about $4.00 to $5.00, can be installed without necessity for using a lift or the like, and will last three to five seasons. It will thus be seen that the objects according to the present invention have been realized.

While the invention has been herein shown and described in what is presently conceived to be the most practical and preferred embodiment thereof, it will be obvious to those of ordinary skill in the art that many modifications may be made thereof within the scope of the invention which scope is to be accorded the broadest interpretation of the appended claims so as to encompass all equivalent structures and devices.

What is claimed is:

1. A floodgate for use in combination with an earthen levee having a cut therein, said floodgate comprising a generally rectangular piece of flexible sheet material having a sufficient length to pass from the bottom of one side of the levee, over the crown of the levee, to the bottom of the other side of the levee, and having a sufficient width to extend completely across the width of the cut in the levee and a substantial distance on either side of the cut in the levee, so that in a flow-passing position of the floodgate, the sheet material completely lines the cut in the levee;

an elongated relatively rigid freely movable pole having a length greater than the width of the cut in the levee, and having a cross-sectional area;

a loop formed in the piece of sheet material along one end thereof, generally across the width thereof, the loop having a void area encompassed thereby at least as great as the cross-sectional area of said pole so that said pole may be rotated to wrap the sheet material around the pole while the pole is received by the loop; and the edge of said sheet opposite said loop being buried underground on the high water side of the levee, and the edges of said sheet adjacent said edge opposite the edge of said sheet having said loop, being buried along the length thereof up to approximately the crown of the levee, and being free from the crown of the levee toward the low water side of the levee.

2. A floodgate as recited in claim 1 wherein said sheet material comprises a plastic sheet.

3. A floodgate as recited in claim 2 wherein said plastic sheet is polyethylene.

4. A floodgate as recited in claim 3 wherein said polyethylene plastic sheet has ultraviolet inhibitor incorporated therein.

5. A floodgate as recited in claim 4 wherein said polyethylene plastic sheet has about 10% ultraviolet inhibitor incorporated therein.

6. A gloodgate as recited in claim 3 wherein said polyethylene plastic sheet is about 14 to 16 mils thick.

7. A floodgate as recited in claim 3 wherein said polyethylene plastic sheet is about 9 feet wide and about 4 feet or more long, not including the loop.

8. A floodgate as recited in claim 1 wherein said sheet material is nylon treated to be water impervious.

9. A combination as recited in claim 1 wherein the levee has a depression formed in the crown thereof for receipt of said pole with part of said plastic sheet wrapped therearound.

* * * * *